US008973310B1

(12) United States Patent
Henderson

(10) Patent No.: US 8,973,310 B1
(45) Date of Patent: Mar. 10, 2015

(54) VENTILATED ROOF SYSTEM AND METHOD

(71) Applicant: John C. Henderson, Springfield, PA (US)

(72) Inventor: John C. Henderson, Springfield, PA (US)

( * ) Notice: Subject to any disclaimer, the term of this patent is extended or adjusted under 35 U.S.C. 154(b) by 0 days.

(21) Appl. No.: 14/199,763

(22) Filed: Mar. 6, 2014

Related U.S. Application Data

(60) Provisional application No. 61/788,427, filed on Mar. 15, 2013.

(51) Int. Cl.
*E04B 7/00* (2006.01)
*E04D 13/17* (2006.01)

(52) U.S. Cl.
CPC ..... *E04D 13/178* (2013.01)
USPC ..... 52/95; 52/302.3; 52/302.1

(58) Field of Classification Search
CPC ..... E04D 13/17; E04D 12/002; E04D 13/178; E04D 13/158
USPC ..... 52/11, 95, 408, 409, 198–199, 201.1, 52/220.4, 220.6, 220.8, 302.3
See application file for complete search history.

(56) References Cited

U.S. PATENT DOCUMENTS

| | | | | |
|---|---|---|---|---|
| 2,318,820 | A * | 5/1943 | Voigt et al. | 52/302.3 |
| 3,683,785 | A * | 8/1972 | Grange | 454/250 |
| 4,852,311 | A * | 8/1989 | Lea | 52/91.3 |
| 7,818,922 | B2 * | 10/2010 | Ellis | 52/95 |
| 2004/0134137 | A1 * | 7/2004 | Geer et al. | 52/95 |
| 2006/0266405 | A1 * | 11/2006 | Lenox | 136/244 |
| 2009/0311495 | A1 * | 12/2009 | Squires et al. | 428/196 |

* cited by examiner

*Primary Examiner* — Jeanette E. Chapman
(74) *Attorney, Agent, or Firm* — Robert J. Yarbrough

(57) ABSTRACT

An energy-efficient ventilated roofing system and method provides a deck protected from the weather by shingles and a sub-deck in a spaced apart relationship below the deck. The sub-deck is covered by a barrier fabric that is permeable to water vapor but that is substantially impermeable to liquid water. The deck and sub-deck define ventilation channels. The barrier fabric allows water vapor to escape from the building while acting as a secondary barrier to liquid water that may penetrate the shingles and deck. The ventilation channels allows the flow of ventilation air under the deck, avoiding damage to the deck and preventing blinding of roof ventilation due to building insulation or structural members or building debris.

18 Claims, 6 Drawing Sheets

VENTILATED ROOF SYSTEM AND METHOD

I. STATEMENT OF RELATED APPLICATIONS

This application is entitled to priority from U.S. Provisional Patent Application 61/788,427 by John C. Henderson filed Mar. 15, 2013. Provisional application 61/788,427 is incorporated by reference as if set forth in full herein.

II. BACKGROUND OF THE INVENTION

A. Field of the Invention

The invention relates to roofing and specifically to roofing ventilation. The ventilated roof system and method of the Invention provides full ventilation of the underside of the roof deck, prevents blinding of ventilation intakes by attic insulation, provides a secondary barrier to water intrusion into the living space of the building, allows elimination of soffits in roof construction, and allows escape of water vapor from the interior of the building.

B. Statement of the Related Art

The portion of a building roof that is exposed to the elements is protected by a durable, weather-resistant surface, such as shingles. As used in this document, the term 'shingle' means tab shingles, architectural shingles, cementatious shingles, metal shingles, slate, sheet metal, tar paper, underlayment, roll roofing, ceramic tile roofing, wood shakes, synthetic versions of any of the above and any other weather proofing product that may be applied to a pitched roof.

The shingles are supported by a roof deck. As used in this document, a 'roof deck' means the generally planar structural covering the upper side of a building and providing support for shingles. The 'roof deck' usually is composed of wood in the form of plywood sheets or dimensioned lumber. The term 'roof deck' also may include other roofing materials previously applied to the plywood or dimensioned lumber, such as tar paper or other underlayment, ice and water shields, and shingles.

The roof deck has a pitch from the eave (lower edge) of the roof to the ridge of the roof so that water and snow will fall from the roof. As used in this document, the term 'ridge' means a high location on a roof, such as where the roof deck intersects another roof deck for a gable or hip roof or intersects a vertical wall for a shed roof.

To apply shingles to a roof deck, the roof deck is first covered by underlayment. The course of shingles proximal to the lower edge of the roof is then nailed to the deck over the underlayment. Each subsequent course of shingles proceeding from the lower edge to the ridge of the roof overlaps the preceding course and is nailed to the roof deck so that water running from each shingle flows onto the top of the adjacent downhill shingle. The underlayment and shingles cooperate to form a composite surface that is tight to rain water, snow melt and water vapor.

The roof deck is supported by rafters that extend from the eave to the ridge of the roof. The ends of the rafters at the eave are covered by a fascia board. As used in this document, the term 'attic' refers to an attic and also refers to any other air space under a roof assembly, such as the space between a ceiling or insulation and a roof deck of a structure equipped with a cathedral ceiling.

Moisture in the form of water vapor is released into the air inside a structure by the occupants of the structure, by the building plumbing systems and by the soil underneath the structure. If that water vapor is trapped under the impermeable shingle roof, the resulting condensation can damage the roof, can damage the remainder of the structure and can promote growth of mold within the attic. To avoid these effects, the space underneath the roof must be ventilated. Ventilation also serves to allow air heated by solar gain to escape from the space under the roof, reducing the cooling load on the building. During daylight hours, the sun shining on the roof warms the roof deck, causing the roof deck to be warmer than the ambient air. The warm roof deck warms the air immediately below the roof deck. During cold weather, heat within the inhabited space of the structure will leak into the attic space, which also warms the air in the attic space. The air within the attic that is warmed by the sun or by escaped building heat expands, becomes buoyant, and tends to rise. Because the roof is pitched, the warm air rises along the roof deck toward the ridge of the roof. The warm air can be released from the ridge by a ridge vent or at the gable from a gable end vent.

Warmed air escaping from the ridge vent will place the attic space at a lower air pressure than the ambient pressure outside the attic. For effective ventilation, eave vents are provided to allow make-up ambient air to enter the area under the roof. A roof equipped with eave and ridge vents acts as a large, low-pressure air pump, pumping air out through the ridge vent and in through the eave vents. The power input to the roof air pump system is heat energy generated either by sunlight shining on the roof deck or by heat leaking into the attic from the heated living space of the structure. If any portion of the roof is starved for ventilation air, then the lack of air flow through the air-starved attic space may cause the problems associated with excess moisture.

Any roof ventilation system must deal with building insulation. Insulation may be applied between joists of an attic space or may be applied between rafters supporting a roof deck. If the insulation blocks the flow of air along the underside of the roof deck, the evils of inadequate ventilation will occur. A problem location in prior art roof ventilation systems is the area of the eaves of the roof. Insulation installed proximal to the eave may block the air intakes, preventing the flow of ventilation air through the attic. Insulation applied between the rafters also may block ventilation air and may be separated from the underside of a roof deck by a baffle, frequently composed of styrofoam. Any improper installation of the baffle or of the insulation can block the flow of air, resulting in excess moisture and condensation. Ventilation air also may be blocked by anything that gets in the way of the air, including the building structure or building debris.

The present invention is not taught by the prior art.

III. BRIEF DESCRIPTION OF THE INVENTION

The Invention is a system for construction of a roof that provides complete ventilation of the underside of the roof deck while allowing water vapor to escape from the structure and avoiding any interference with the ventilation of the roof deck due to blockage of air flow by insulation or by other building materials such as wood, dry wall, metal beams, masonry, or any other structural components or construction debris that may block the flow of air under the roof deck.

The roof ventilation system includes a pitched sub-deck installed on the rafters of a structure. The sub-deck is composed of plywood sheet, dimensioned lumber or oriented strand board and covers the rafters. The sub-deck must be strong enough to support a worker during installation of the roofing system and strong enough not to sag excessively after construction is completed. Once the roof is completed, the structural duties of the sub-deck are minimal and so the sub-roof deck may be light in weight. Plywood having a thickness of ⅜" has proven suitable in practice for the sub-deck. Where the ventilated roofing system of the invention is retrofitted to an existing roof, the deck of the existing roof becomes the sub-deck of the ventilated roofing system of the Invention. The ends of the rafters below the sub-deck are covered by a sub-fascia. Where the ventilated roofing system of the Invention is retrofitted to an existing roof, the prior art fascia board of the existing roof becomes the sub-fascia of the ventilated roofing system.

A barrier fabric composed of a liquid water-impermeable and water vapor-permeable flexible non-woven fabric is installed over the top of the sub-deck. An example of such a fabric is Tyvek® Home Wrap® by DuPont. A second example is Tyvek® Attic Wrap, which features a reflective layer. A third example is Typar® House Wrap by Polymer Group, Inc. The barrier fabric is permeable to water vapor, so water vapor penetrating through the structure is not stopped by the barrier fabric and can pass through the barrier fabric. Liquid water, however, cannot pass through the barrier fabric under the pressures that the fabric will experience on a roof. The fabric barrier drapes over the edge of the sub-deck and the sub-fascia at the eave of the roof and may be attached to the sub-fascia.

Furring strips are installed on top of the barrier fabric and are attached to the sub-deck and the rafters. A 'furring strip' is one or more elongated members, such as dimensioned lumber, that are disposed on top of the barrier fabric and that run from proximal to the eave to the ridge of the roof. Each furring strip is located above a rafter and is nailed through the barrier fabric to the rafter. The top of the furring strip is in a spaced-apart relation to the top of the barrier fabric. A separation between the top of the barrier fabric and the top of the furring strip of about 1.5 inches has proven suitable in practice.

The roof deck is composed of plywood, dimensioned lumber or oriented strand board and spans the adjacent furring strips. The roof deck provides the structural support for the weather-resistant surface of the roof. Underlayment and shingles cover the roof deck in the conventional manner, providing a water-impermeable composite surface to the roof deck. The roof deck is in the spaced-apart relation to the barrier fabric and the sub-deck. The separation between the roof deck and the barrier fabric also serves to protect the barrier fabric from nail penetrations by nails used to install the shingles to the roof deck.

The space between the barrier fabric and the underside of the roof deck and between each pair of adjacent furring strips defines a ventilation channel to provide a flow of air to the underside of the roof deck. The exit to the ventilation channels is any suitable exhaust vent located so as to exhaust air from a ventilation channel. The exhaust vent may be a ridge vent or may be a vent installed at the intersecting planes of a hip roof. The exhaust vent may be installed proximal to the top of a shed roof or may be installed at any intermediate location on a roof deck requiring ventilation; for example, below an architectural feature such as a skylight that otherwise would block the flow of air through the ventilation channel.

The intake to the ventilation channels is any suitable soffit or eave intake vent. An intake vent that has proven suitable in practice is a corrugated plastic intake vent attached to the sub-fascia. The barrier fabric overlaps the sub-deck and sub-fascia at the eave and is disposed between the intake vent and the sub-fascia, securing the barrier fabric to the sub-fascia. The corrugated plastic intake vent has an inlet side and an exhaust side. The inlet side of the plastic intake vent is exposed to the ambient air outside the structure. The exhaust side of the corrugated plastic intake vent is disposed within the ventilation channel, so that the corrugated plastic vent communicates between the ambient air outside the structure and the ventilation channel. The corrugated plastic vent is covered by a fascia that blocks access to the ventilation channels other than through the corrugated plastic intake vent. A gutter to control water flowing from the roof may be attached to the fascia.

The corrugated plastic vent prevents entry of insects, animals, debris and water into the ventilation channels. The disposition of the plastic corrugated vents assures that blowing rain or snow cannot enter the intake vents. An overflowing gutter at a roof edge is a common location for entry of water into a structure. Any water overflowing on the building side of a gutter mounted to the fascia is prevented from entering the structure by the barrier fabric.

The ventilation channels provide protected ventilation for the roof that cannot be blocked by insulation, allowing insulation to be packed into the attic in a quantity and manner that would otherwise block conventional ventilation. The barrier fabric serves as secondary containment for any water that may penetrate the weather-resistant surface of the roof deck or enter through the ridge vent. Rather than entering the occupied portion of the structure, the water is conveyed to the roof edge and discharged through the corrugated plastic intake vent to the outside of the structure. The barrier fabric is not exposed to sunlight or to weather, and so should last indefinitely. The water vapor-permeable barrier fabric also allows the water vapor that otherwise would condense on the sub-deck to pass through the sub-deck and to be exhausted from the building.

If a barrier fabric with a reflective surface is used, the reflective surface reduces radiant heat gain or loss through the barrier fabric and hence through the roof.

The installation of any roofing product presents obvious hazards to the installers because of the potential for falls. The use of the sub-deck in the roofing system of the Invention allows installation of the barrier fabric and the remainder of the roof system by an installer who can physically stand upon the sub-deck, which promotes safety—a major consideration in any roofing installation.

The ventilated roof system of the invention may be retrofitted to an existing roof with little or no work conducted within the building. The ventilated roof system also provides a thermal break from the conditioned air inside the building, aiding energy efficiency of the building. To fully realize the energy savings of the ventilated roofing system in a retrofit of an existing roof, existing openings into the attic are closed, such as existing gable end vents, existing ridge vents and existing intake vents.

Roofing product makers, such as shingle makers, frequently limit warranties of the installed roofing products to roofs that have adequate ventilation. The superior ventilation of the roof system of the Invention will preserve rights under those warranties. Because the superior ventilation, the ventilated roof system of the invention will last longer than a conventional roof, saving the building owner the expense of replacement and saving roofing contractors the costs of warranty claims. The sub-deck protects the barrier fabric during the life of the roof from damage from below, as by a homeowner moving things about in the attic.

IV. BRIEF DESCRIPTION OF THE DRAWINGS

V. DESCRIPTION OF AN EMBODIMENT

Figure 1:
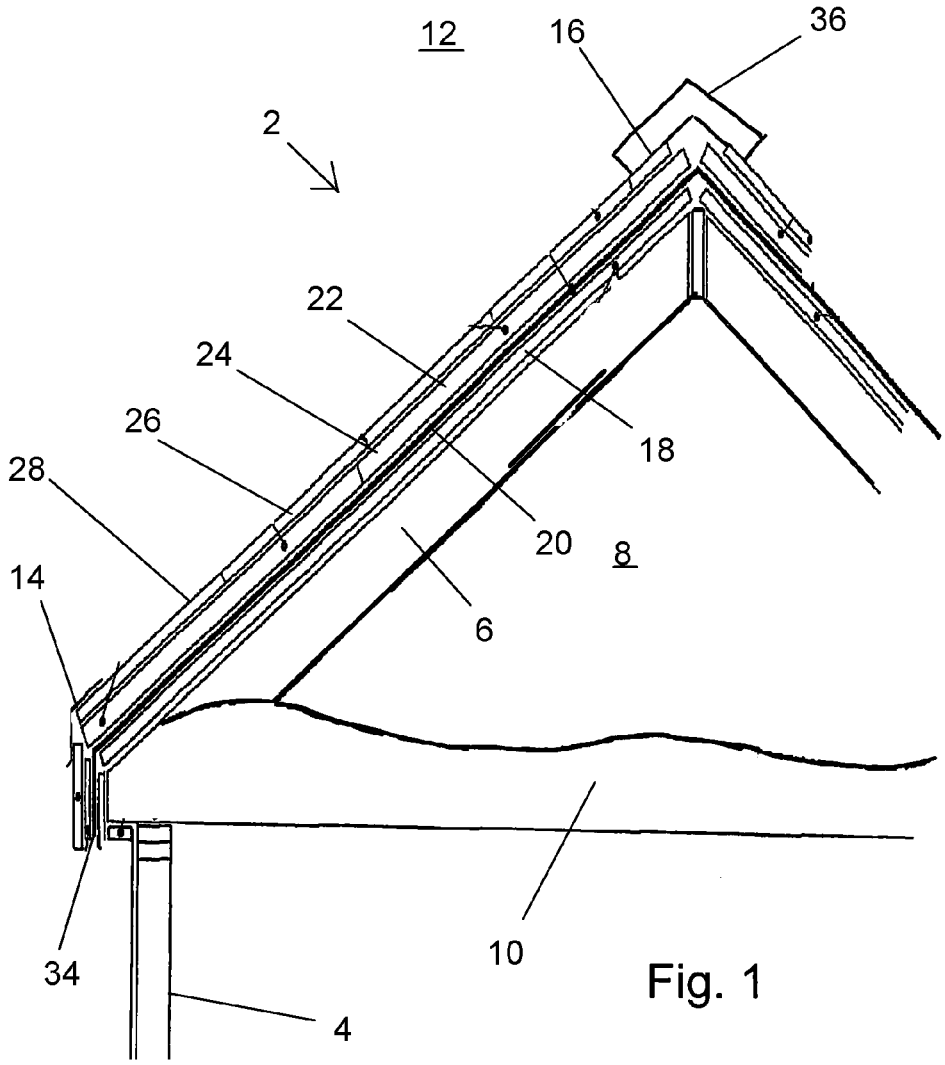
FIG. 1 is a cross section of a ventilated roof system of the Invention from a gable end.

FIGS. 1 through 6 illustrate the construction and operation of the ventilated roof system 2 of the Invention. FIG. 1 presents an overview of the ventilated roof system 2 in cross section from a gable end. A building 4 has a plurality of rafters 6 that support the ventilated roof system 2. The building 4 and ventilated roof system 6 defines an attic 8. The attic 8 includes insulation 10 to slow heat transfer between the interior of the building 4 and the outside air 12. Because of the ventilated roof system 2 of the Invention, the insulation may be packed into the eave 14 without blocking ventilation of the ventilated roof system 2 and without damage to the building 4. The rafters 6 have a pitch between the eave 14 and the ridge 16. The pitch of the rafters 6, and hence of the ventilated roof system 2, causes rain water, snow and debris to tend to run off of the ventilated roof system 2.

The ventilated roof apparatus 2 includes a sub-deck 18 that is attached to and supported by the rafters 6, generally by nails penetrating through the sub-deck 18 and extending into the rafters 6. The sub-deck 18 is composed of plywood, oriented strand board or dimensioned lumber that sheathes the top surface of the rafters 6.

The sub-deck supports a sheet of barrier fabric 20 that covers the sub-deck 18. The barrier fabric 20 is composed of a non-woven polymer that is permeable to water vapor 22 (FIG. 2) but is not permeable to liquid water under the conditions that the barrier fabric 20 can reasonably be expected to encounter. Examples of suitable barrier fabric 20 are Tyvek® Home Wrap®, Tyvek® Attic Wrap, both by Dupont, and Typar® House Wrap by Polymer Group, Inc. Tyvek® Attic Wrap includes a reflective coating that assists in slowing the movement of heat between the outside air 12 and the building interior.

Furring strips 24 are attached to the barrier fabric 20, sub-deck 18 and the rafter 6, generally by nails penetrating the furring strips 24, barrier fabric 20, sub-deck 18 and extending into the rafters 6. The furring strips 24 extend from the eave 14 to the ridge 16. The furring strips 24 may be composed of any suitable material, but 2×3 or 2×4 dimensioned lumber has proven suitable.

The deck 26 is attached to the furring strips 24. The deck 26 is composed of plywood, oriented strand board or dimensioned lumber. Shingles 28, as defined above, are attached to the top surface of the deck 26 and provide a barrier to weather. The furring strips 24 separate the sub-deck 18 and the deck 26 so that the deck 26 and sub-deck 18 are in a spaced-apart relation 30. Where the furring strips 24 are 2×3 or 2×4 dimensioned lumber, the deck 26 and sub-deck 18 are separated by 1.5 inches, which has proven suitable in practice. Any other suitable thickness for the furring strips 24 and hence the spaced-apart relation 30 of the deck 26 and sub-deck 18 may be used, provided that the separation is large enough to allow adequate ventilation of the deck 26 and is small enough to avoid an unpleasant appearance of the ventilated roof system 2.

The spaced-apart relation 30 of the deck 26 and sub-deck 18 defines ventilation channels 32 extending from the eve 14 to the ridge 16. A suitable intake vent 34 allows ambient air 12 to enter the ventilation channels 32 proximal to the eave 14. A suitable exhaust vent 34 allows air to exit the ventilation channels 32 proximal to the ridge 16. While any intake 30 may be used, the RafterVent by DCI Products, 415 South Penn Street, Clifton Heights, Pa. 19018 has proven suitable in practice for the intake vent 34. While any exhaust vent 36 may be used, the SmartRidge I and SmartRidge II exhaust vents by DCI Products are suitable for the exhaust vent 36.

Figure 2:
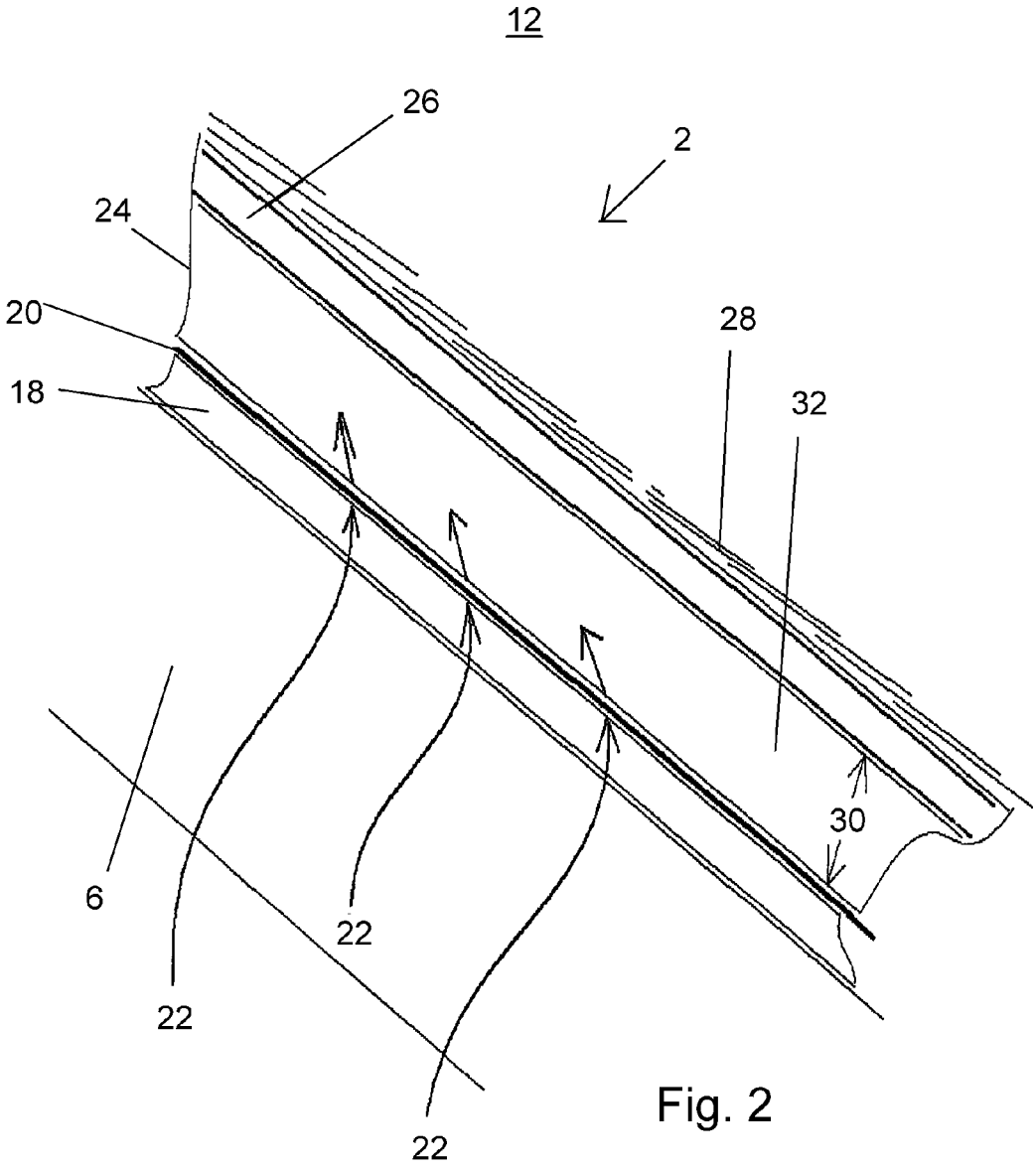
FIG. 2 is a detail side view of the ventilated roof system of the invention.

FIG. 2 illustrates the operation of the ventilated roof system 2 for control of water vapor 22 from the interior of the building 4. Water vapor 22 escapes into the air 12 on the interior of the building from the building occupants, from plumbing systems, from cooking and bathing, and from the soil underneath the building 4. If the water vapor 22 is not controlled, it will condense and promote mold growth and damage to the building 4. The water vapor 22 penetrates the walls, floors and ceilings of the building 4 and will be present in the attic 8. The water vapor 22 in the attic penetrates the sub-deck 18 and the barrier fabric 20 and enters the ventilation channels 32. The water vapor 20 laden air 12 is exhausted through the exhaust vents 36, avoiding condensation within the building and the consequences of inadequate ventilation.

As shown by FIG. 2, the barrier fabric 20 also serves as a secondary barrier to the intrusion of water through the shingles 28 and deck 26 and into the interior of the building 4. If liquid water from rain or snow manages to penetrate the shingles 24 and the deck 26, the liquid water encounters the barrier fabric 20 through which it cannot pass. The liquid water flows on top of the barrier fabric 20 downward to the eave 14, where the liquid water is discharged outside the building 4. The presence of the barrier fabric 20 thus protects the building 4 from intrusion by liquid water should the shingles 28 be damaged due to mishap or age.

Figure 3:
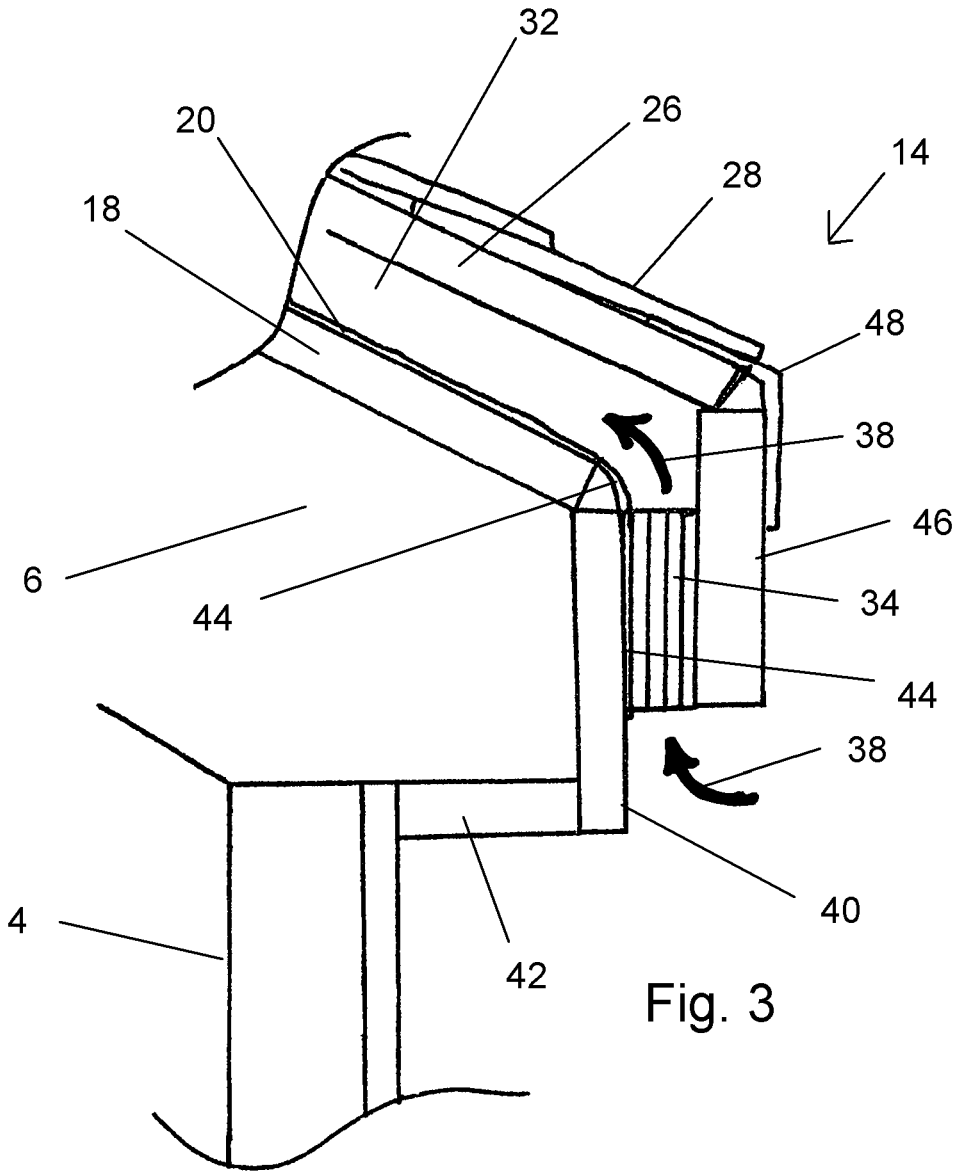
FIG. 3 is a detail cross section side view of the eave of the ventilated roof system.
Figure 4:
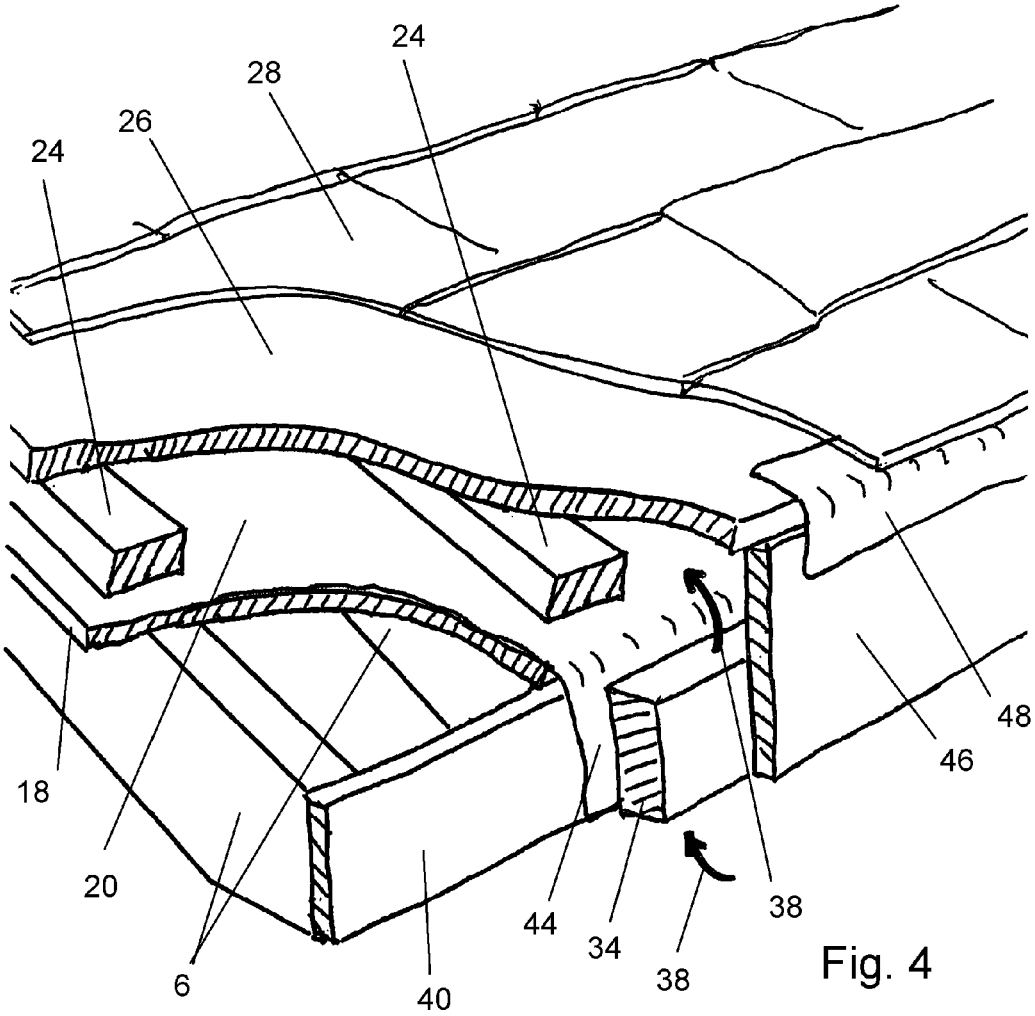
FIG. 4 is a detail cutaway perspective view of the eave of ventilated roof system.
Figure 5:
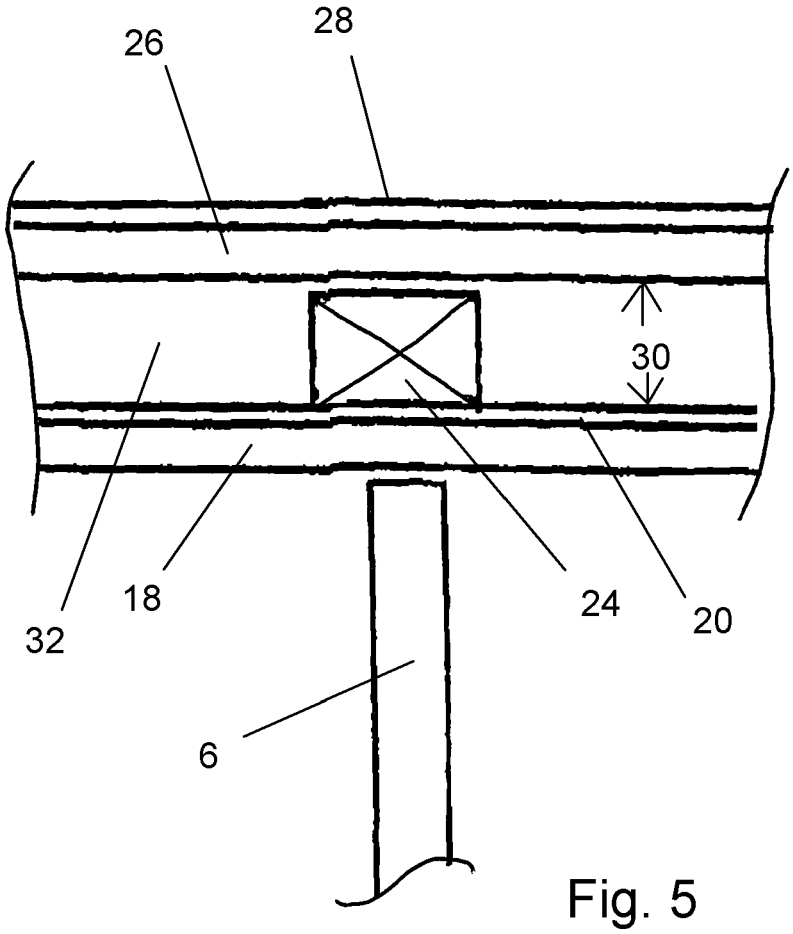
FIG. 5 is a detail cross section view of the ventilated roof system viewed parallel to a rafter.

The construction of the ventilated roof system at the eave 14 is illustrated by FIGS. 3 and 4. FIG. 4 is a cross section of the ventilated roof system 2 at the eave 14. FIG. 5 is a partial perspective cutaway of the ventilated roof system 2 at the eave 14. From FIGS. 3 and 4, the sub-deck 18 terminates at the end of the rafter 6, where it meets a sub-fascia 40. The sub-fascia board 40 covers the end of the rafters 6. The sub-fascia 40 and the soffit 42 in cooperation define a closed eave. Where the ventilated roof system 2 of the Invention is retrofitted to an existing roof, the sub-fascia 40 may be the fascia board of the existing roof. The barrier fabric 20 on top of the sub-deck 18 extends beyond the lower edge of the sub-deck 18 to define an overhang 44 that drapes over the sub-fascia 40. The overhang 44 prevent liquid water, for example liquid water from an overflowing gutter, from entering the building 4 through the junction of the sub-fascia 40 and the sub-deck 18.

The intake vent 34 is attached to the sub-fascia 40, with the overhang 44 disposed between the intake vent 34 and the sub-fascia 40. The intake vent 34, in this instance a RafterVent by DCI Products, allows air 12 to pass through many small channels defined by the intake vent 34. The air 12 moves as indicated by arrows 38. The air 12 moves through the intake vent 34 due to solar heating of air 12 within the ventilation channels 32 or due to warming of the air within the ventilation channels 32 due to escaped building heat. The warmed air 12 is less dense than cooler air 12 outside of the building 4 and tends to rise toward the ridge 16, where the air discharges from the exhaust vent 36.

Also from FIGS. 3 and 4, the lower end of the ventilation channels 32 are closed by a fascia 46, which also covers the intake vent 34, hiding the intake vent. Flashing 48 prevents liquid water from entering the building 4 at the junction of the fascia 46 and the deck 26.

FIG. 5 illustrates the operation of the furring strips 24 and is an end view of the ventilated roof system 2 in section. From FIG. 5, the furring strips 24 have a height that defines the spaced-apart relation 30 of the deck 26 and the sub-deck 18. The height of the furring strips 24 also prevents nails securing the shingles 28 to the deck 26 from damaging the barrier fabric 20.

Figure 6:
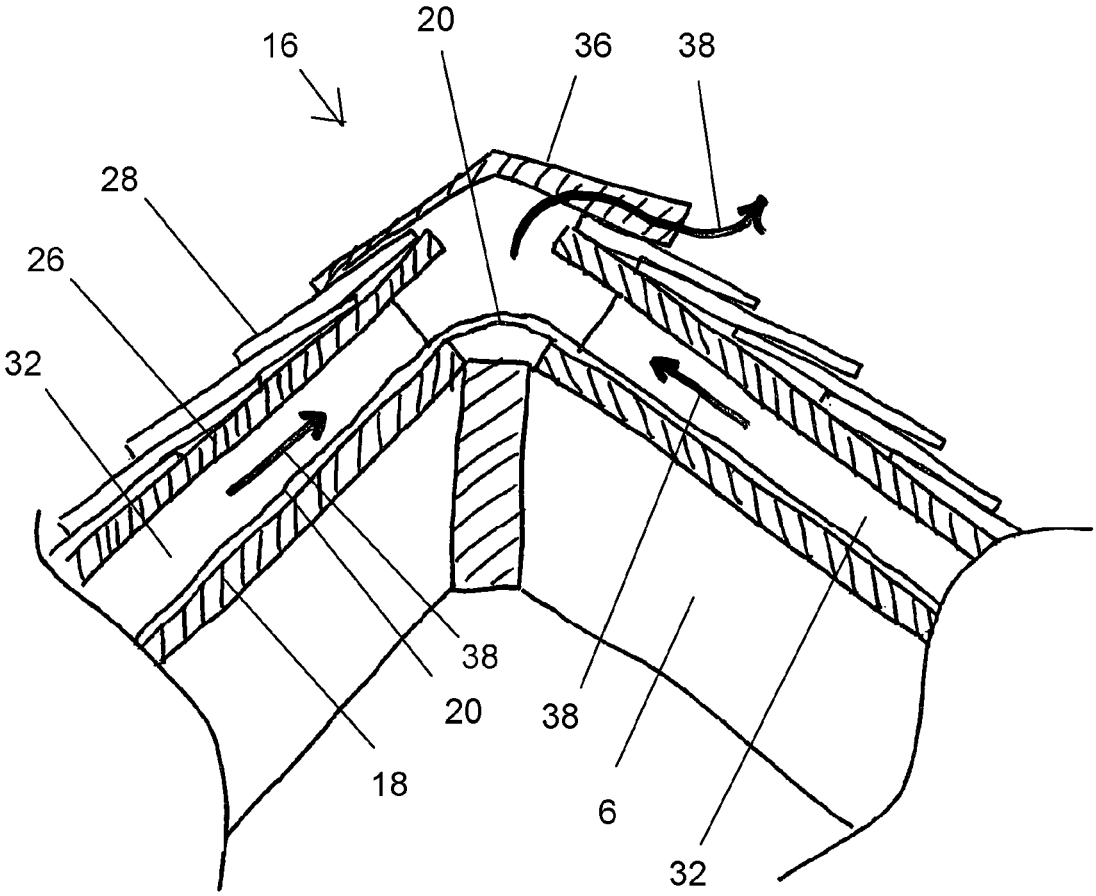
FIG. 6 is a detail cross section side view of the ridge of the ventilated roof system.

FIG. 6 illustrates the ventilated roof system 2 at ridge 16. The ridge 16 is a high location on the ventilated roof system 2 and air 12 moves through the ventilation channel 32 and discharges through the exhaust vent 36. The exhaust vent 36 illustrated is a SmartRidge I by DCI Products, but any suitable exhaust vent 36 may be used.

From FIG. 6, the barrier fabric 20 extends over the entire surface of the sub-deck 18 and extends over the ridge 16. If the ventilated roof system 2 of the invention is installed on an existing roof, the sub-deck 18 is defined by the original roof deck of the roof being replaced. That original roof deck may define openings at the ridge for ventilation. The extension of the barrier fabric 20 over those openings in the original roof deck ensures that liquid water cannot enter the building through the openings.

LIST OF NUMBERED ELEMENTS ventilated roof system 2
a building 4
rafter 6
attic 8
insulation 10
outside air 12
eave 14
ridge 16
a sub-deck 18
a barrier fabric 20
water vapor 22
furring strips 24
a deck 26
shingles 28
a spaced apart relation 30
a ventilation channel 32
an intake vent 34
an exhaust vent 36
arrows 38 indicating movement of air
sub-fascia 40
soffit 42
an overhang 44
fascia 46
flashing 48

I claim:

1. A ventilated roof system, the system comprising:

a. a building;

b. a sub-deck, said sub-deck being attached to and supported by said building, said sub-deck having a pitch, said sub-deck being permeable to water-vapor;

c. a barrier fabric disposed upon and supported by said sub-deck, said barrier fabric being permeable to water-vapor and substantially impermeable to liquid water, said barrier fabric and said sub-deck being adequately water-vapor permeable to avoid condensation in an unventilated attic under said sub-deck;

d. a deck, said deck being supported in a spaced apart relation to said sub-deck, said deck and said sub-deck defining a ventilation channel between said barrier fabric and said deck;

e. a plurality of shingles, said plurality of shingles being attached to and supported by said deck.

2. The ventilated roof system of claim 1 wherein said deck defines an eave, the system further comprising: an intake vent, said intake vent being disposed proximal to said eave, said intake vent being in fluid communication between an outside air and said ventilation channel.

3. The ventilated roof system of claim 2 wherein said barrier fabric defines an overhang at said eave, said overhang being disposed between said intake vent and said building.

4. The ventilated roof system of claim 3, the system further comprising: a fascia, said fascia being disposed at said eave, said fascia covering said ventilation channel, said fascia being configured to block entry to said ventilation channel except through said intake vent.

5. The ventilated roof apparatus of claim 4, the apparatus further comprising: a sub-fascia, said sub-fascia being disposed at said eave, said overhang of said barrier fabric being disposed between said sub-fascia and said intake vent, said intake vent being attached to said sub-fascia.

6. The ventilated roof system of claim 2, the system further comprising: an exhaust vent, said exhaust vent communicating between said ventilation channel and said outside air.

7. The ventilated roof system of claim 1 wherein said building defines a plurality of rafters, said sub-deck being attached to and supported by said plurality of rafters.

8. The ventilated roof system of claim 7, the system further comprising: a plurality of furring strips, said furring strips being attached to said sub-deck, said barrier fabric being disposed between said furring strips and said sub-deck, each of said furring strips being located above a one of said rafters, said deck being attached to said plurality of furring strips, said furring strips supporting said deck, said furring strips having a height, said spaced apart relation between said sub-deck and said deck being defined by said height of said furring strips.

9. The ventilated roof apparatus of claim 1 wherein said barrier fabric is a non-woven polymer fabric.

10. The ventilated roof apparatus of claim 9 wherein said barrier fabric has a reflective surface.

11. A method of installing a ventilated roofing system on a building having a plurality of rafters having a pitch, the method comprising:

a. installing a sub-deck on said rafters, said sub-deck being planar, said sub-deck having a sub-deck top, said sub-deck being permeable to water vapor;

b. installing a barrier fabric on said sub-deck top, said barrier fabric being substantially impermeable to liquid water, said barrier fabric being permeable to water vapor, said barrier fabric and said sub-deck being adequately permeable to water vapor to avoid condensation in an unventilated attic below said sub-deck;

c. installing a deck in a spaced-apart relation to said sub-deck top and said barrier fabric, said deck being planar, said deck and said barrier fabric in combination defining a ventilation channel;

d. installing a shingle on said deck.

12. The method of claim 11 wherein said deck defines an eave, the method further comprising: installing an intake vent, said intake vent being disposed proximal to said eave, said intake vent being in fluid communication between an outside air and said ventilation channel.

13. The method of claim 12 wherein said barrier fabric defines an overhang at said eave, the method further comprising: draping said overhang over said eave, said draped barrier fabric being disposed between said intake vent and said building.

14. The method of claim 12, the method further comprising: installing a fascia engaging said intake vent, said fascia being disposed at said eave, said fascia being configured to block entry to said ventilation channel except through said intake vent.

15. The method of claim 12, the method further comprising: installing an exhaust vent, said exhaust vent communicating between said ventilation channel and said outside air.

16. The method of claim 11, the method further comprising: installing a plurality of furring strips after said step of installing said barrier fabric and before said step of installing said deck, said furring strips being attached to said barrier fabric, each of said furring strips being located above a one of the rafters, said step of installing said deck further comprising attaching said deck to said plurality of furring strips so that said furring strips support said deck, said furring strips having a height, said spaced apart relation between said sub-deck and said deck being defined by said height of said furring strips.

17. The method of claim 11 wherein said barrier fabric is a non-woven polymer fabric.

18. The method of claim 17 wherein said barrier fabric has a reflective surface.

* * * * *